US011360409B2

(12) United States Patent
Nakagawa

(10) Patent No.: US 11,360,409 B2
(45) Date of Patent: Jun. 14, 2022

(54) IMAGE FORMING APPARATUS WITH A DRIVE MOTOR TO DRIVE A TONER CONVEYANCE PART AND OVERCURRENT PREVENTION THEREOF

(71) Applicant: KYOCERA Document Solutions Inc., Osaka (JP)

(72) Inventor: Ryo Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/209,909

(22) Filed: Mar. 23, 2021

(65) Prior Publication Data

US 2021/0302874 A1 Sep. 30, 2021

(30) Foreign Application Priority Data

Mar. 24, 2020 (JP) ..... JP2020-053224

(51) Int. Cl.

*G03G 15/08* (2006.01)
*G03G 15/00* (2006.01)
*G03G 21/14* (2006.01)

(52) U.S. Cl.

CPC ..... *G03G 15/0887* (2013.01); *G03G 15/0848* (2013.01); *G03G 15/0858* (2013.01); *G03G 15/5004* (2013.01); *G03G 15/5012* (2013.01); *G03G 15/55* (2013.01); *G03G 21/145* (2013.01)

(58) Field of Classification Search

CPC ..... G03G 15/0848; G03G 15/0858; G03G 15/0887; G03G 15/5004; G03G 15/5012; G03G 15/55; G03G 21/145

See application file for complete search history.

(56) References Cited

U.S. PATENT DOCUMENTS

2020/0218188 A1* 7/2020 Hatori ..... G03G 15/55

FOREIGN PATENT DOCUMENTS

JP 2012-198359 A 10/2012
JP 2012198359 A * 10/2012
WO WO-2019088536 A1 * 5/2019 ..... G03G 15/55

* cited by examiner

*Primary Examiner* — Joseph S Wong
(74) *Attorney, Agent, or Firm* — Studebaker & Brackett PC

(57) ABSTRACT

An image forming apparatus includes an image forming part, a toner storage part, a toner conveyance part, a drive motor and a control part. The image forming part forms an image on a sheet using a toner. The toner storage part stores the toner replenished to the image forming part. The toner conveyance part conveys the toner. The drive motor generates a drive force by which the toner conveyance part conveys the toner. The control part generates a control signal for controlling the drive motor, based on information showing a rotational speed of the drive motor. The control part executes a determination processing for determining whether a driving of the drive motor is stopped, based on the control signal.

5 Claims, 4 Drawing Sheets

IMAGE FORMING APPARATUS WITH A DRIVE MOTOR TO DRIVE A TONER CONVEYANCE PART AND OVERCURRENT PREVENTION THEREOF

INCORPORATION BY REFERENCE

This application is based on and claims the benefit of priority from Japanese patent application No. 2020-053224 filed on Mar. 24, 2020, which is incorporated by reference in its entirety.

BACKGROUND

The present disclosure relates to an image forming apparatus.

In an electrophotographic type image forming apparatus, a development process is performed by supplying a toner from a development device to an electrostatic latent image formed on a surface of a photosensitive drum. The toner is stored in a toner storage part (a toner container). In the toner storage part, a toner conveyance part having a rotating blade is disposed.

The toner conveyance part is driven by a drive motor. The toner is conveyed while being agitated by the toner conveyance part driven by the drive motor to be rotated. The toner conveyed while being rotated is replenished through an opening formed in the toner storage part to the development device.

By the way, the toner in the toner storage part may be aggregated during transportation to a user. When the toner is aggregated, the drive motor which agitates the toner is applied with an overload. Owing to the overload, an overcurrent may flow through the drive motor.

For example, an image forming apparatus may be configured to stop the drive motor in a case where a rotation of the drive motor is not detected within a predetermined time after a drive instruction signal is sent to the drive motor.

By the way, in the above described image forming apparatus, it takes time to determine that the drive motor and the rotational blade are not rotated. Then, there is s possibility that the overcurrent follows through the drive motor before the determination is made. Therefore, there is room for improvement in the processing for stopping the drive motor.

SUMMARY

In accordance with an aspect of the present disclosure, an image forming apparatus includes an image forming part, a toner storage part, a toner conveyance part, a drive motor and a control part. The image forming part forms an image on a sheet using a toner. The toner storage part stores the toner replenished to the image forming part. The toner conveyance part conveys the toner. The drive motor generates a drive force by which the toner conveyance part conveys the toner. The control part generates a control signal for controlling the drive motor, based on information showing a rotational speed of the drive motor. The control part executes a determination processing for determining whether a driving of the drive motor is stopped, based on the control signal.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
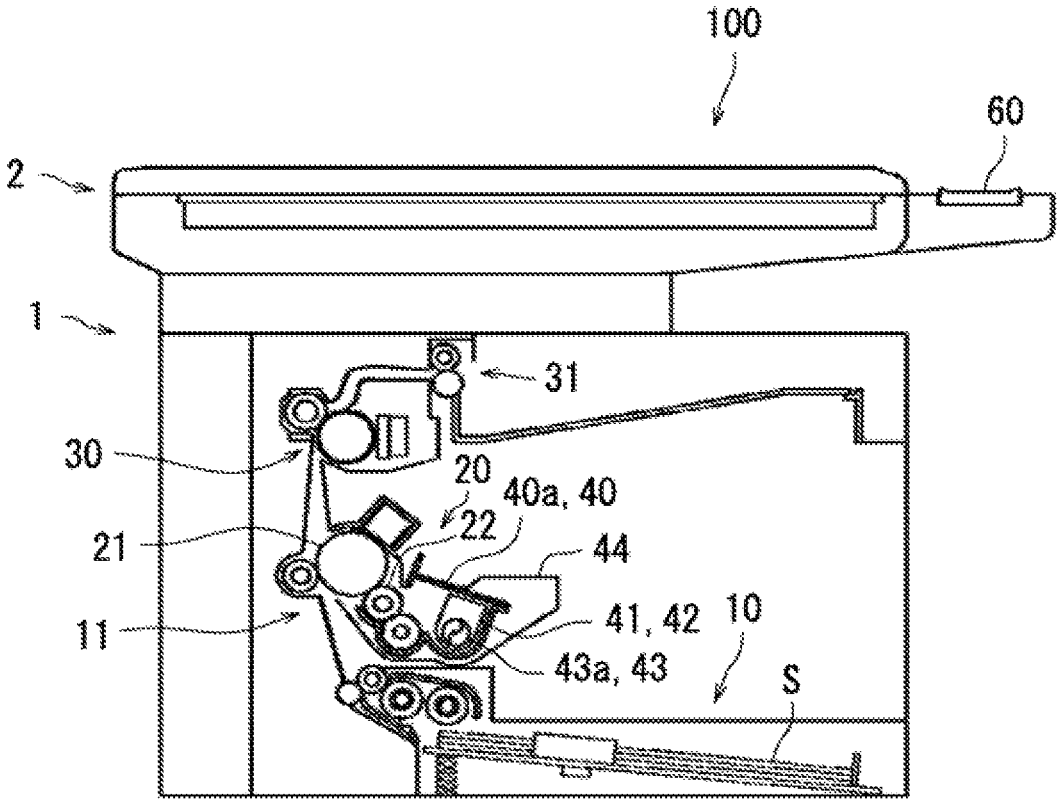
FIG. 1 is a view showing a configuration of an image forming apparatus according to one embodiment of the present disclosure.

Hereinafter, with reference to the attached drawings, an embodiment in the present disclosure will be described. In the drawings, the same or corresponding portions are marked with the same reference numerals, and the description will not be repeated.

Figure 2:
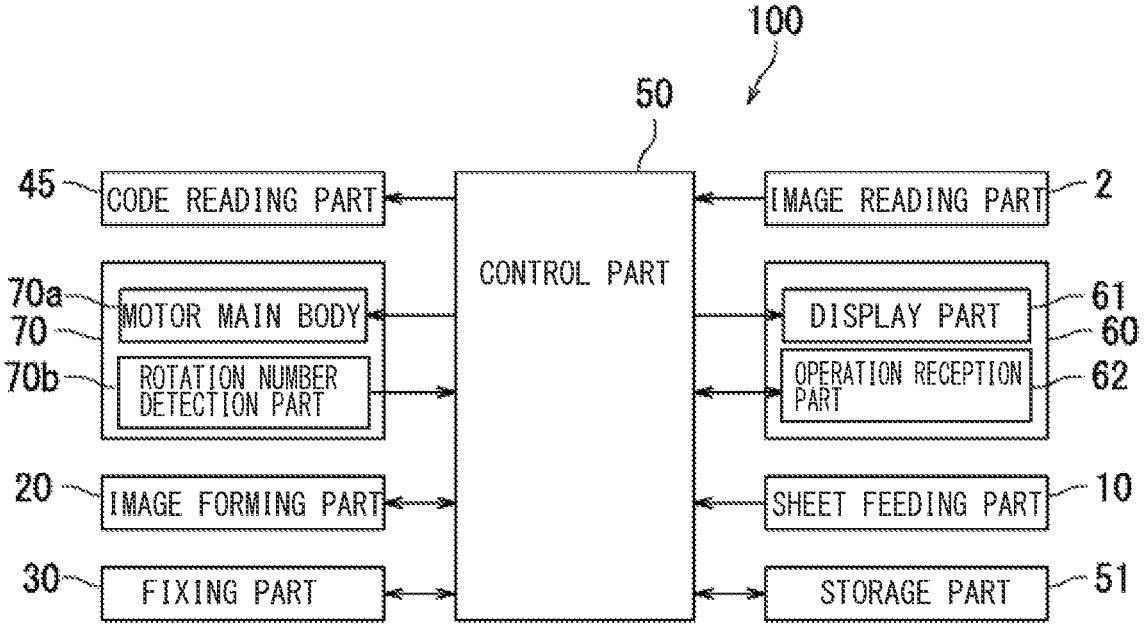
FIG. 2 is a block diagram showing the configuration of the image forming apparatus according to the embodiment of the present disclosure.

With reference to FIG. 1 and FIG. 2, a configuration and an operation of an image forming apparatus 100 in the present embodiment will be described. FIG. 1 is a view showing a configuration of the image forming apparatus 100, and FIG. 2 is a block diagram showing the configuration of the image forming apparatus 100.

The image forming apparatus 100 is a copying machine or a multifunctional peripheral, for example. The image forming apparatus 100 shown in FIG. 1 includes an apparatus main body 1 which forms an image on a sheet S and fixes the image on the sheet S, an image reading part 2 and an operation panel 60.

The image reading part 2 is an image reading device (a scanning device), for example. The image reading part 2 is connected to the apparatus main body 1. The operation panel 60 includes a display part 61 and an operation reception part 62.

As shown in FIG. 1 and FIG. 2, the apparatus main body 1 includes a sheet feeding part 10, a sheet conveyance part 11, an image forming part 20, a fixing part 30 and a discharge part 31 as a configuration for image formation. Further, the apparatus main body 1 includes a toner replenishment part 41, a toner storage part 42, a toner conveyance part 43, a drive motor 70 and a code reading part 45 as a configuration for replenishment of toner to the image forming part 20. Further, the apparatus main body 1 includes a control part 50 and a memory part 51.

The sheet feeding part 10 feeds the sheet S to the sheet conveyance part 11. The sheet feeding part 10 includes a lift-up type sheet tray and a pickup rollers pair.

The sheet tray stores a plurality of the sheets S. The pickup rollers pair picks up the sheet S one by one from the sheet tray, and feeds it to the sheet conveyance part 11.

The sheet conveyance part 11 includes a plurality of guide plates and a plurality of conveyance rollers pairs. The plurality of guide plates and the plurality of conveyance rollers pairs are disposed along a conveyance path for the sheet S.

The sheet conveyance part 11 conveys the sheet S fed from the sheet feeding part 10 to the discharge part 31 through the image forming part 20 and the fixing part 30.

The image forming part 20 forms an image on the sheet S. In the present embodiment, the image forming part 20 forms the image on the sheet S in an electrophotographic manner. Specifically, the image forming part 20 includes a photosensitive drum 21 (an image carrier), a charging device, an exposure device, a development part 22, a transferring device, a cleaning device and an erasing device.

The sheet conveyance part 11 conveys the sheet S on which the image is formed, to the fixing part 30.

The fixing part 30 fixes the image on the sheet S. The fixing part 30 includes a pressure member and a heating member. The fixing part 30 heats and presses the sheet S to fix the image on the sheet S.

The sheet conveyance part 11 conveys the sheet S on which the image is fixed, to the discharge part 31.

The discharge part 31 discharges the sheet S outside the apparatus main body 1. The discharge part 31 includes a discharge rollers pair.

Figure 3:
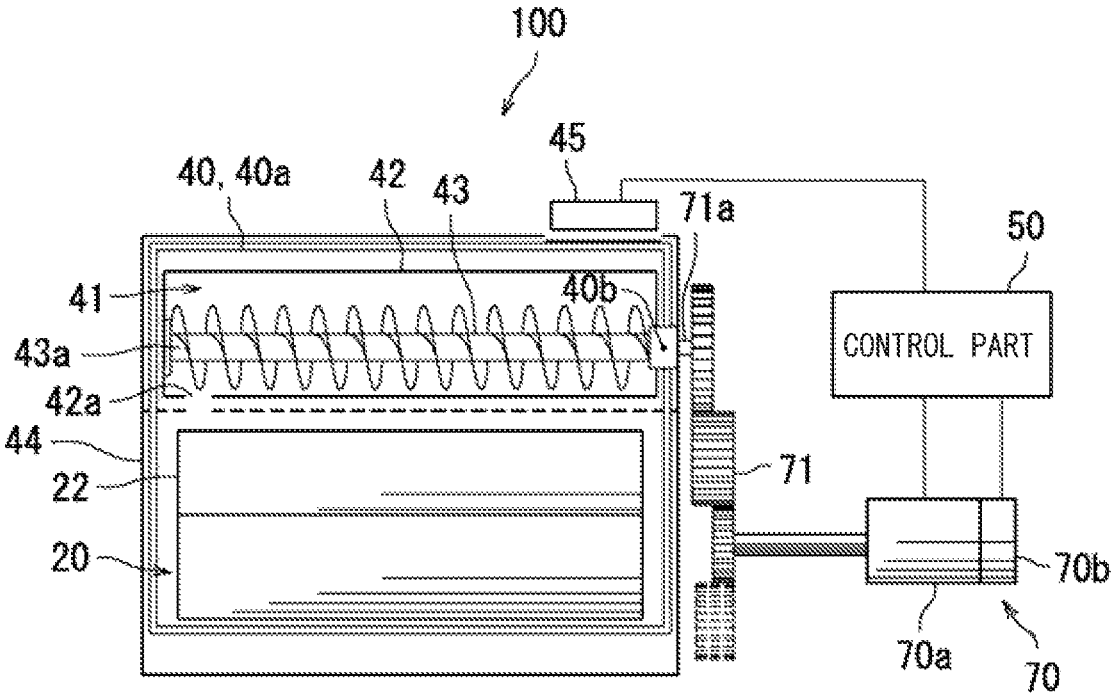
FIG. 3 is a view showing a structure which replenishes a toner, in the image forming apparatus according to the embodiment of the present disclosure.

With reference to FIG. 1, FIG. 2 and FIG. 3, the configuration for replenishment of the toner to the image forming part 20 will be described. FIG. 3 is a view showing the configuration for replenishment of the toner from the toner replenishment part 41 to the image forming part 20 in the image forming apparatus 100 in the present embodiment.

As shown in FIG. 1, the image forming apparatus 100 in the present embodiment includes a unit 40 and a unit attachment part 44. The unit 40 is attached to the unit attachment part 44 in an attachable and detachable manner. The unit 40 is a replacement member of the image forming apparatus 100.

The unit 40 includes a unit case 40*a*, the development part 22 which is one part of the image forming part 20, and the toner replenishment part 41. The unit case 40*a* stores the development part 22 and the toner replenishment part 41. The unit case 40*a* is a case made of resin, for example. To the unit attachment part 44, the unit case 40*a* is attached.

The toner replenishment part 41 replenishes the toner to the development part 22. Specifically, the toner replenishment part 41 includes the toner storage part 42 and the toner conveyance part 43.

The toner storage part 42 stores the toner. The toner conveyance part 43 includes a screw 43*a*. When the screw 43*a* is rotated, the toner is suppled from the toner storage part 42 to the development part 22. Further, when the screw 43*a* is rotated, the toner in the toner storage part 42 is agitated.

As shown in FIG. 3, the drive motor 70 generates a drive force for driving the toner conveyance part 43. The drive force generated from the drive motor 70 is transmitted to one end of the screw 43*a* to rotate the screw 43*a*.

Specifically, the image forming apparatus 100 further includes a drive force transmission mechanism 71. The drive force transmission mechanism 71 transmits the drive force generated from the drive motor 70 to the one end portion of the screw 43*a*.

In detail, the drive force transmission mechanism 71 includes a plurality of gears, for example. The plurality of gears of the drive force transmission mechanism 71 contains a gear disposed at a tip end of a drive shaft of the drive motor 70.

The unit 40 includes a drive coupling part 40*b* coupled to the one end portion of the screw 43*a*. One of the plurality of gears of the drive force transmission mechanism 71 (hereinafter, refer to as "a coupling gear") faces the drive coupling part 40*b*.

The drive force transmission mechanism 71 includes a shaft 71*a* coupled to the coupling gear. When the unit case 40*a* is attached to the unit attachment part 44, one end of the shaft 71*a* is coupled to the drive coupling part 40*b*. Then, a drive (a rotation) of the coupling gear is transmitted to the screw 43*a*.

As shown in FIG. 3, an opening 42*a* is formed in one end portion of the toner storage part 42. Specifically, the opening 42*a* is formed on the other end side of the screw 43*a*. The screw 43*a* includes a rotating shaft (a shaft) and a spiral rotating blade (a conveyance blade or an agitating blade). The rotating blade is provided around an outer circumferential face of the shaft.

The shaft extends in the longitudinal direction of the toner storage part 42. When the drive force of the drive motor 70 is transmitted to the one end portion of the screw 43*a* through the drive force transmission mechanism 71, the screw 43*a* is rotated by the drive force.

When the screw 43*a* is rotated, the conveyance blade or the agitating blade of the screw 43*a* conveys the toner in the toner storage part 42 in one direction (the left direction in FIG. 3).

Specifically, the screw 43*a* conveys the toner to the other end side of the screw 43*a*. Therefore, the toner is conveyed to the side of the opening 42*a*. The toner conveyed to the opening 42*a* is replenished to the development part 22 through the opening 42*a*.

The code reading part 45 shown in FIG. 3 is disposed in a position adjacent to the predetermined one face of the unit case 40*a* attached to the unit attachment part 44. The code reading part 45 reads identification information of the unit 40.

The code reading part 45 magnetically reads the identification information, for example. The identification information is a serial number assigned to the unit 40, for example. In a case where the code reading part 45 magnetically reads the identification information, an IC tag is disposed on the one face of the unit case 40*a*, for example. The IC tag stores the identification information.

In this case, the code reading part 45 includes an RFID reader. The RFID reader is disposed so as to face the IC tag. The RFID reader reads the identification information from the IC tag when disposed so as to face the IC tag.

Therefore, when the unit case 40*a* is attached to the unit attachment part 44, the RFID reader of the code reading part 45 reads the identification information from the IC tag of the unit case 40*a*.

The RFID reader sends a signal showing information read from the IC tag to the control part 50. The code reading part 45 is an example of a detection part.

The code reading part 45 may optically read the identification information. In this case, a seal on which a two-dimensional bar code showing the identification information is printed is adhered on the one face of the unit case 40*a*.

In a case where the two-dimensional bar code is used, the code reading part 45 includes an imaging device. The control part 50 causes the code reading part 45 to image the two-dimensional bar code when the unit case 40*a* is attached to the unit attachment part 44. When the two-dimensional car code is imaged, the code reading part 45 outputs a signal showing the imaged image to the control part 50.

Alternatively, it may be a one-dimensional bar code in place of the two-dimensional bar code. In a case where the one-dimensional bar code is adhered on the unit case 40*a*, the code reading part 45 includes a bar code reader.

As shown in FIG. 3, the drive motor 70 includes a motor main body 70*a* and a rotation number detection part 70*b*. The motor main body 70*a* is a DC brush motor or a DC brushless motor, for example. The control part 50 includes a drive circuit for adjusting the rotation of the motor main body 70*a*.

The rotation number detection part 70*b* is an incremental encoder, for example. The rotation number detection part

70*b* detects a rotation number per unit time (rpm) or a rotational speed for the motor main body 70*a*.

The rotation number detection part 70*b* outputs a signal showing the detected rotation number per unit time (rpm) or rotational speed for the motor main body 70*a*, to the control part 50. The control part 50 executes a feedback control on the motor main body 70*a* based on the signal showing the detected rotation number per unit time (rpm) or rotational speed for the motor main body 70*a*.

As shown in FIG. 2, the image forming apparatus 100 includes the control part 50 and the memory part 51. The operation panel 60 includes the display part 61 and the operation reception part 62.

The control part 50 includes a processer such as a CPU (a Central Processing Unit). The control part 50 executes computer program stored in the memory part 51 to control each component of the image forming apparatus 100.

The control part 50 controls the drive motor 70 based on the signal showing the detected rotation number per unit time (rpm) or rotational speed for the motor main body 70*a*. Specifically, the control part 50 generates a control signal for controlling the motor main body 70*a* such that a rotational number of the drive motor 70 approaches a target value, based on the rotational number (rpm) of the drive motor 70.

In detail, the control part 50 generates the control signal for controlling a current value of a current supplied to the motor main body 70*a*.

The control part 50 executes a determination processing for determining whether the driving of the drive motor 70 and the driving of the screw 43*a* driven by the drive motor 70 are stopped, based on the control signal.

Specifically, the control part 50 monitors a current value of a current supplied to the motor main body 70*a*. Hereinafter, the current supplied to the motor main body 70*a* is sometimes referred to as "a motor drive current". The current value of the motor drive current is sometimes referred as "a motor drive current value".

The control part 50 determines whether the motor drive current value is larger than a threshold value. The threshold value shows a value smaller than a current value at which the motor main body 70*a* is in an overload state. The threshold value is stored in the memory part 51.

Further, the control part 50 generates a control signal depending on the attachment of the unit case 40*a* to the unit attachment part 44, and drives the drive motor 70.

In other words, the control part 50 rotates the screw 43*a* of the toner conveyance part 43 depending on the attachment of the unit case 40*a* to the unit attachment part 44. Therefore, the control part 50 executes the determination processing depending on the attachment of the unit case 40*a* to the unit attachment part 44.

That is, the control part 50 determines whether the motor drive current value is equal to or larger than the threshold value, depending on the attachment of the unit case 40*a* to the unit attachment part 44.

Specifically, when the code reading part 45 reads the identification information of the unit 40 depending on the attachment of the unit case 40*a* to the unit attachment part 44, the control part 50 determines whether the unit 40 is replaced with a new unit 40.

When it is determined that the unit 40 is replaced with the new unit 40, the control part 50 generates the control signal, rotates the screw 43*a* and executes the determination processing.

When the motor drive current value is equal to or larger than the threshold value before a predetermined time elapses after the rotating of the screw 43*a* is started, the control part 50 stops the generation of the control signal and stops the driving of the drive motor 70. In other words, the control part 50 stops the driving of the toner conveyance part 43 (the rotation of the screw 43*a*) before the overcurrent flows through the motor.

As a result of the determination processing, when the driving of the toner conveyance part 43 is stopped, the control part 50 displays an error message on the display part 61. The error massage notifies of a possibility that the toner in the toner storage part 42 is aggregated, for example. The display part 61 is an example of a notification part in the present disclosure.

The control part 50 stops the generation of the control signal and stops the drive motor 70 after the predetermined time elapses even when the motor drive current value is not equal to or larger than the predetermined value within the predetermined time.

In a case where the motor main body 70*a* is a DC motor, the control part 50 may generate a control signal for controlling a voltage value of a voltage (hereinafter, referred to as "a motor drive voltage") applied to the motor main body 70*a* and monitor a voltage value of the motor drive voltage.

The memory part 51 includes a main storage device such as a ROM (a Read Only Memory) and a RAM (a Random Access Memory). The memory part 51 may include an auxiliary storage device such as HDD (a Hard Disk Drive). The memory part 51 stores various computer programs and various data.

The memory part 51 stores a target value of a rotation number (rpm) or a rotational speed of the drive motor 70.

Further, the memory part 51 stores the identification information of the unit 40 read by the code reading part 45.

When the code reading part 45 reads the identification information of the unit 40 depending on the attachment of the unit case 40*a* to the unit attachment part 44, the control part 50 determines whether the identification information matched the identification information read this time is stored in the memory part 51.

When it is determined that the identification information matched the identification information read this time is stored in the memory part 51, the control part 50 determines that the unit attached this time is not new.

On the other hand, when it is determined that the identification information matched the identification information read this time is not stored in the memory part 51, the control part 50 determines that the unit 40 attached this time is new.

The display part 61 is a liquid crystal display device (LCD), for example. The display part 61 displays various screen.

In a case where the display part 61 is a touch display, a user operation is received by touching with a finger or the others.

The operation reception part 62 is a hard key, for example. The hard key receives various operation form the user.

Figure 4:
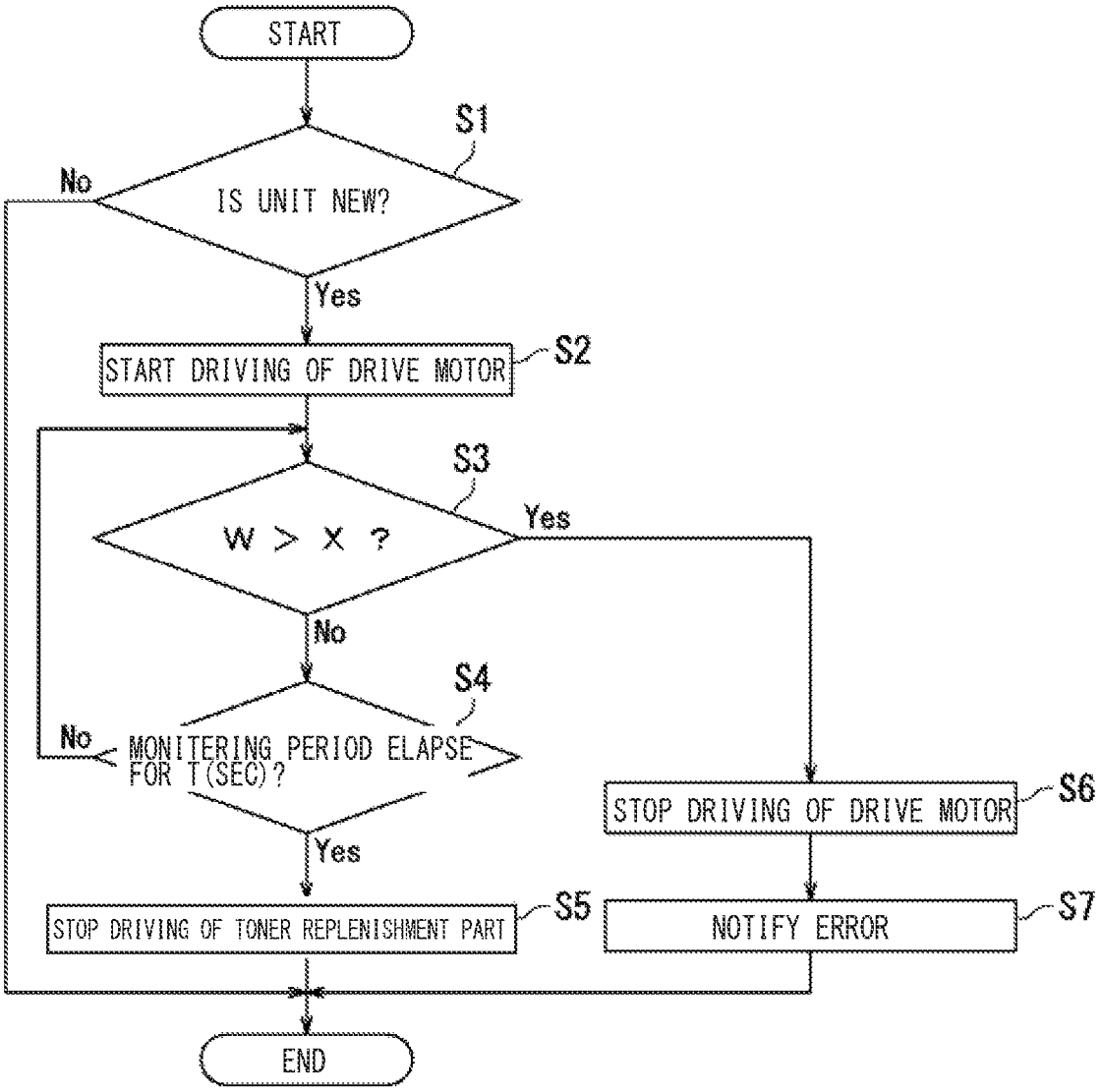
FIG. 4 is a flowchart showing a determination processing executed at a time of replacing of a unit.

Next, with reference to FIG. 4, the determination processing executed by the control part 50 when the unit 40 is replaced will be described. FIG. 4 is a flowchart showing the determination processing executed at a time of replacing of the unit.

The processing shown in FIG. 4 starts depending on the attachment of the unit case 40*a* to the unit attachment part 44.

As shown in FIG. 4, when the unit case 40*a* is attached to the unit attachment part 44, in step S1, the control part 50 determines whether the replaced unit 40 by the attachment and detachment is new.

In step S1, when it is determined that the replaced unit 40 is not new (S1: No), the control part 50 completes the processing (end).

On the other hand, in step S1, when it is determined that the replace unit 40 is new (S1: Yes), the processing proceeds to step S2.

In step S2, the control part 50 drives the toner replenishment part 41. Specifically, the control part 50 rotates the screw 43*a*. In detail, the control part 50 generates the control signal, starts to supply a current to the drive motor 70 and executes the feedback control on the drive motor 70.

When the toner replenishment part 41 is started to be driven, in step S3, the control part 50 determines whether the motor drive current value W is larger than the threshold value X.

The motor drive current value W continues to increase by the feedback control if the toner in the toner storage part 42 is aggregated during transportation of the unit 40.

Specifically, when the aggregation of the toner is not loosened even if the screw 43*a* is rotated, the motor drive current value W continues to increase. As a result, an overcurrent flows through the drive motor 70, and the drive motor 70 may be in an overload state.

As described above, the threshold value X is a value smaller than a current value at which the motor main body 70*a* is in the overload state.

When it is determined that the motor drive current value W is larger than the threshold value X in step S3 (S3: Yes), in step S6, the control part 50 stops the driving of the toner replenishment part 41. Specifically, the control part 50 stops the driving of the drive motor 70, and stops the driving of the screw 43*a*.

When the driving of the screw 43*a* is stopped, in step S7, the control part 50 displays the error message on the display part 61, and the determination processing shown in FIG. 4 is completed (end).

On the other hand, when it is determined that the motor drive current W is not larger than the threshold value X in step S3 (is smaller, S3: No), in step S4, the control part 50 determines whether a period elapsed after the driving of the drive motor 70 is started (hereinafter, referred to as "a monitoring period") exceeds a predetermined period T.

The predetermined period T is equal to or smaller than 3 minutes, for example. In the present embodiment, the predetermined period T is 60 seconds.

When the monitoring period does not exceed the predetermined period T (S4: No), the control part 50 returns the processing to step S3. In other words, the control part 50 repeats the processing for determining whether the motor drive current value W is larger than the threshold value X until the monitoring period exceeds the predetermined period T.

When the monitoring period exceeds the predetermined period T in step 4 (S4: Yes), in other words, when the toner loosening period elapses, the control part 50 stops the driving of the drive motor 70, stops the driving of the toner replenishment part 41 in step S5, and completes the processing shown in FIG. 4 (end).

According to the embodiment described above, in the image forming apparatus 100, when the unit 40 is replaced, even if the toner aggregation occurs in the toner storage part 42, it becomes possible to suppress the flowing of an overcurrent through the drive motor 70 driving the screw 43*a*. Since the toner tends to aggregate during transportation and storage, the control part 50 executes the determination processing depending on the attachment of the toner storage part 42 to the unit attachment part 44, so that the determination processing can be executed efficiently. Further, even when a degree of the toner aggregation is high, such as during transportation or storage, since the determination processing is executed for a predetermined period of time after the toner storing part 42 is attached to the unit attachment part 44, it becomes possible to suppress the flowing of the overcurrent through the drive motor 70 surely. Furthermore, since the error message is displayed on the display part 61 after the drive motor 70 is stopped, maintenance can be performed quickly.

The embodiments of the present disclosure have been described with reference to the drawings. However, the present disclosure is not limited to the above embodiments, and may be performed in various embodiments without departing from the gist thereof. For example, some components may be removed from all components shown in the embodiments. The drawings schematically show the respective components mainly for convenience of easy understanding, and the thickness, length, number, interval, and the like of each component shown are different from the actual ones for convenience of drawing preparation. The material, shape, dimension, and the like of the component shown in the above embodiments are only examples, and are not particularly limited, and various changes can be made without substantially departing from the structure of the present disclosure.

For example, in the embodiment described with reference to FIG. 1 to FIG. 4, the determination processing executed when the toner is loosened immediately after the unit 40 (a toner container) is replaced is described, but the determination processing of the present disclosure may be executed on other occasions when aggregation of the toner is concerned. For example, when the image forming apparatus 100 is not used for a long period of time or when vibration is applied to the apparatus main body 1 by displacing the installation place of the image forming apparatus 100, the determination processing of the embodiment may be performed.

The present disclosure is applicable to the field of an image forming apparatus.

The invention claimed is:

1. An image forming apparatus comprising:

an image forming part which forms an image on a sheet using a toner;

a toner storage part which stores the toner replenished to the image forming part;

a toner conveyance part which conveys the toner;

a drive motor which generates a drive force by which the toner conveyance part conveys the toner; and a control part which controls a current value of a current supplied to the drive motor, wherein the control part stops the driving of the drive motor when the current value of the drive motor becomes larger than a threshold value lower than a current value at which the drive motor is in an overload state, before a toner loosening period elapses after the driving of the drive motor is started.

2. The image forming apparatus according to claim 1, wherein the control part stops the driving of the drive motor when a predetermined monitoring period elapses after the driving of the drive motor is started, even if the current value of the drive motor is not larger than a threshold value lower than a current value at which the drive motor is in an overload state.

3. The image forming apparatus according to claim 1, further comprising:

an attachment part to which the toner storage part is attached; and a detection part detecting whether the toner storage part is attached to the attachment part, wherein the toner storage part is attachable and detachable to and from the attachment part, and the control part executes the determination processing depending on an attachment of the toner storage part to the attachment part.

4. The image forming apparatus according to claim 3, wherein the control part executes the determination processing for a predetermined period after the toner storage part is attached to the attachment part.

5. The image forming apparatus according to claim 1, further comprising a notification part which notifies a user of information, wherein the control part causes the notification part to notify error message when the determination processing is executed to stop the driving of the drive motor.

* * * * *